US005897265A

United States Patent [19]

Wilson

[11] Patent Number: 5,897,265

[45] Date of Patent: Apr. 27, 1999

[54] INK ERASER

[76] Inventor: Caroline Wilson, 5131 Bundy Rd. Apt. U-30, New Orleans, La. 70127

[21] Appl. No.: 08/852,058

[22] Filed: May 6, 1997

[51] Int. Cl.[6] ..... B43K 27/10

[52] U.S. Cl. ..... 401/199; 401/17; 401/18; 401/198

[58] Field of Search ..... 401/17, 18, 198, 401/199; 252/FOR 125

[56] References Cited

U.S. PATENT DOCUMENTS

| | | | |
|---|---|---|---|
| 3,941,488 | 3/1976 | Maxwell | 401/17 |
| 4,076,427 | 2/1978 | Anderson | 401/198 |
| 4,932,802 | 6/1990 | Cantone | 401/17 |
| 5,306,092 | 4/1994 | Jeng | 401/47 |
| 5,324,131 | 6/1994 | Gardner, III | 401/199 |
| 5,342,136 | 8/1994 | Fukami | 401/135 |
| 5,362,167 | 11/1994 | Laftin | 401/198 |

FOREIGN PATENT DOCUMENTS

| | | | |
|---|---|---|---|
| 2342 | 8/1872 | United Kingdom | 252/125 FOR |

*Primary Examiner*—David J. Walczak
*Assistant Examiner*—Tuan Nguyen
*Attorney, Agent, or Firm*—Joseph N. Breaux

[57] ABSTRACT

An ink eraser including an eraser housing defining a housing chamber and a nib opening; a first fibrous wick container positioned within the housing chamber; a first section of fibrous wicking material positioned within the fibrous wick container; a supply of erasing agent within the fibrous wick container, the erasing agent including a mixture of vinegar and an organic bleach; and a delivery nib having a wick contacting portion, a central portion and a delivery portion, the wick contacting portion being positioned within the fibrous wick container in contact with the first section of fibrous wicking, the central portion being disposed through the nib opening, the delivery portion extending exteriorly of the eraser housing. In a preferred embodiment the eraser housing further defines a fill opening and the ink eraser further includes a sealing cap. The sealing cap preferably defines a recharging port that is sealable by a reusable sealing device such as a screw in cap.

1 Claim, 3 Drawing Sheets

INK ERASER

TECHNICAL FIELD

The present invention relates to erasing devices used for erasing ink marking on substrates such as paper and more particularly to an erasing device for erasing ink from a paper surface that includes an erasing agent including a mixture of vinegar and an organic bleach. The organic bleach is preferably in a solid form suitable for dissolving over a period of time in vinegar.

BACKGROUND ART

Highlighter and other ink dispensing pens are a convenient tool for writing, note taking, etc. The ink dispensing pens typically contain a supply of ink that is dispensed onto a paper or other writing surface through a porous nib. Although this is an effective mechanism for writing on a surface, mistakes are often difficult to erase. It would be desirable, therefore, to have an erasing device for erasing undesirable ink that has been applied to a surface. Because such erasing devices can include an organic bleach, such as a chlorine based bleach, for bleaching organic pigments found in inks, it would be further desirable to have such an erasing device that included an erasing agent delivery system that minimized release of the organic bleach into the air during the manufacturing process.

GENERAL SUMMARY DISCUSSION OF INVENTION

It is thus an object of the invention to provide an erasing mechanism for erasing undesirable ink from a surface.

It is a further object of the invention to provide an ink eraser that can be manufactured with minimal airborne release of organic bleach during the manufacturing process.

It is a still further object of the invention to provide an ink eraser that can be recharged by the user solely through the addition of vinegar to an erasing agent storage chamber.

It is a still further object of the invention to provide an ink eraser that includes a fibrous wick container containing two sections of fibrous wicking wherein solid granules of organic bleach are positioned between the two fibrous wicking sections and adjacent to a delivery nib.

It is a still further object to provide an ink eraser that includes a fibrous wick container containing a section of fibrous wicking wherein the fibrous wicking material is soaked with an erasing agent including a mixture of vinegar and organic bleach.

It is a still further object of the invention to provide an ink eraser that accomplishes some or all of the above objects in combination.

Accordingly, an ink eraser is provided. The ink eraser includes an eraser housing defining a housing chamber and a nib opening; a first fibrous wick container positioned within the housing chamber; a first section of fibrous wicking material positioned within the fibrous wick container; a supply of erasing agent within the fibrous wick container, the erasing agent including a mixture of vinegar and an organic bleach; and a delivery nib having a wick contacting portion, a central portion and a delivery portion, the wick contacting portion being positioned within the fibrous wick container in contact with the first section of fibrous wicking, the central portion being disposed through the nib opening, the delivery portion extending exteriorly of the eraser housing.

In a preferred embodiment, some of the organic bleach is in a solid form. Use of a solid form organic bleach minimizes the airborne emission of the organic bleach into the air and provides a safer working environment during assembly of the eraser device. In addition, because the vinegar can be added at a later time, even by the consumer, shipping and handling of the eraser device is simplified.

In a preferred embodiment the eraser housing further defines a fill opening and the ink eraser further includes a sealing cap. The sealing cap preferably defines a recharging port that is sealable by a reusable sealing device such as a screw in cap.

When solid form organic bleach is used, the solid organic bleach is preferably solid calcium hypochlorite. The solid organic bleach is preferably formed in a manner such that it is slowly dissolved by the vinegar over an extended period of time. An example of such forming is a solid form toilet tank bleach releasing disk.

The solid organic bleach can be shaped into various sizes and shapes. Solid organic bleach granules and molded shapes such as spikes and disks are preferred. When a molded shape, such as a disk is used, it is preferred to provide a number of percolation holes through the molded shape to increase the surface area of the solid organic bleach in contact with the vinegar.

The fibrous wicking is preferably an inorganic material such as fibrous rayon.

The ink eraser of the present invention can also be advantageously combined with an ink dispensing pen, such as highlighter or marking pens, to form a combination ink eraser and ink dispensing pen.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
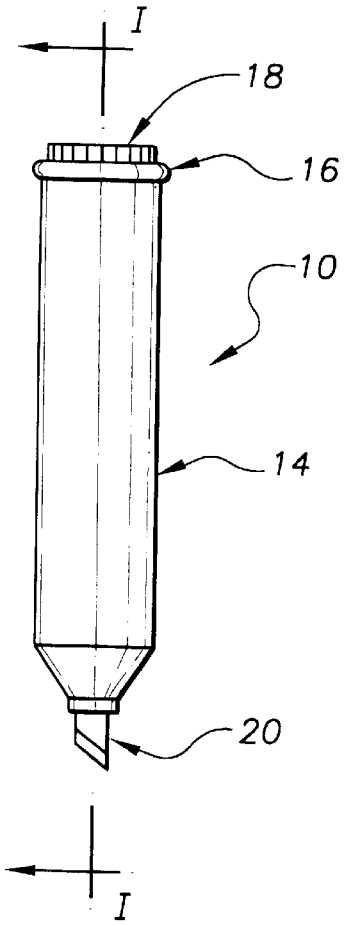
FIG. 1 is a plan view of an exemplary embodiment of the ink eraser of the present invention showing the external housing, the snap-in sealing cap, the screw in cap covering the recharging port, and the delivery nib extending out through a nib opening.
Figure 2:
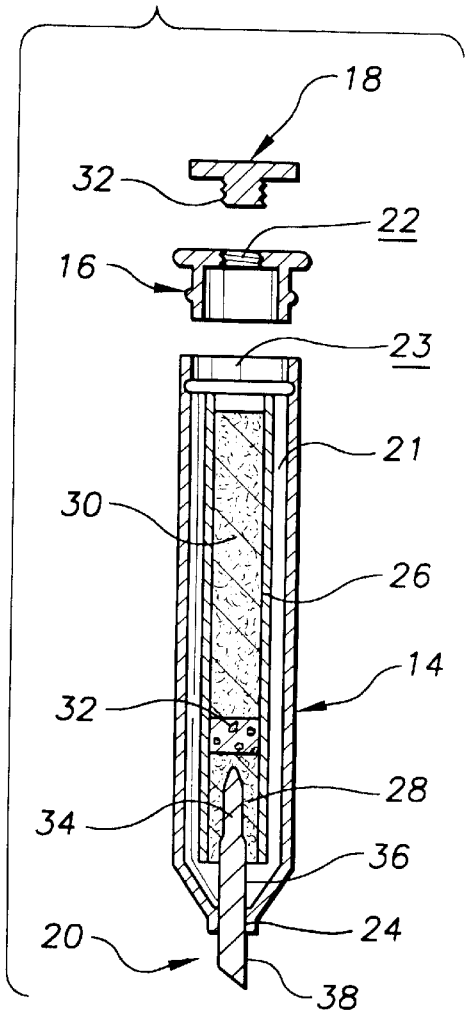
FIG. 2 is a cross-sectional view of the ink eraser of FIG. 1 along the line I—I showing the housing chamber of the eraser housing; the snap-in sealing cap; the screw in cap; the recharging port; the delivery nib; the nib opening; and a first exemplary fibrous wick container having the first section of fibrous wicking material, the second section of fibrous wicking material, and the supply of solid bleach granules provided therein.

FIG. 1 shows a first exemplary embodiment of the ink eraser of the present invention, generally designated by the numeral 10. Ink eraser 10 includes a molded plastic eraser housing, generally designated 14; a snap-in sealing cap, generally designated 16; a screw in cap, generally designated by the numeral 18; a delivery nib, generally designated by the numeral 20; and referring now to FIG. 2, a housing chamber 21; a threaded recharging port 22; a fill opening 23; a nib opening 24; a fibrous wick container 26, a first section of fibrous wicking material 28, a second section of fibrous wicking material 30, and a supply of solid bleach granules 32.

Snap-in sealing cap 16 is molded plastic and snap fits into fill opening 23. Fill opening is used to insert fibrous wick container 26 into housing chamber 21.

In this embodiment, screw-in cap 18 is molded of plastic and is provided with a threaded portion 32 that screws into and seals threaded recharging port 22. Delivery nib 20 is formed from porous plastic and includes a wick contacting portion 34 positioned within first fibrous wicking section 28, a central portion 36 positioned through nib opening 24, and a delivery portion 38 that extends exteriorly of eraser housing 14.

Figure 3:
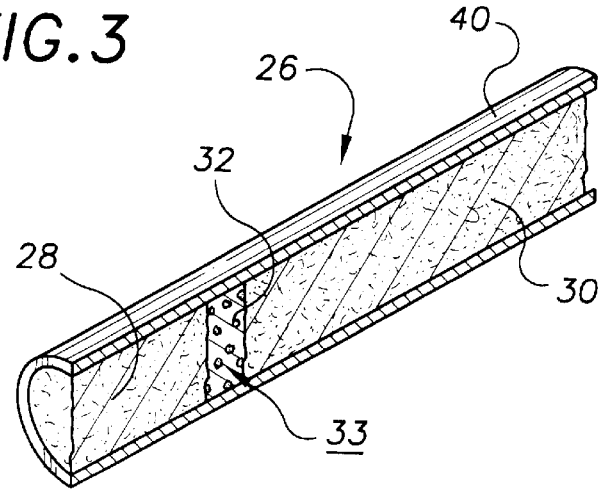
FIG. 3 is a cross sectional view of the first exemplary fibrous wick container showing the shrink sleeve, the first section of fibrous wicking material, the second section of fibrous wicking material, the bleach granule compartment formed between the first and second section of fibrous wicking material, and the supply of solid bleach granules provided within the bleach granule compartment.

With reference now to FIG. 3, in this embodiment fibrous wick container 26 is a length of heat shrinkable plastic tubing 40 into which first section of fibrous wicking material 28 and second section of fibrous wicking material 30 are inserted to form a compartment 33 for containing solid bleach granules 32. After first section of fibrous wicking material 28 and second section of fibrous wicking material 30 are inserted, heat is applied to the heat shrinkable tubing section 40. As tubing section 40 shrinks, first section of fibrous wicking material 28 and second section of fibrous wicking material 30 are compressed and held firmly in place. In this embodiment, solid bleach granules 32 contain 65% calcium hypochlorite and 35% inert binding ingredients.

Figure 4:
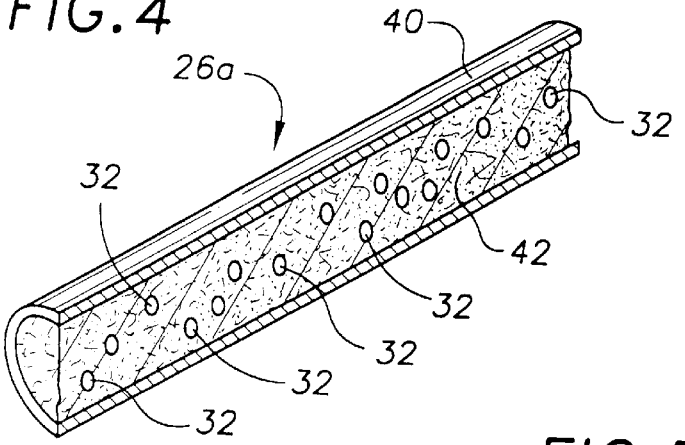
FIG. 4 is a cross sectional view of a second exemplary fibrous wick container showing the shrink sleeve, and a single section of fibrous wicking material that has solid bleach granules dispersed throughout.

With reference to FIG. 4, a second alternative construction of fibrous wick container is shown, generally designated by the reference 26*a*. Fibrous wick container 26*a* is constructed from an identical length of heat shrinkable plastic tubing 40 into which a single section of fibrous wicking material 42 has been inserted. In this embodiment, a combination of fast dissolving and slow dissolving solid bleach granules 32 are dispersed throughout single section of fibrous wicking material 42.

Figure 5:
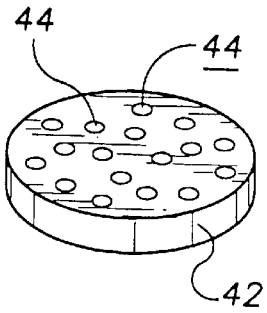
FIG. 5 is a perspective view of a solid bleach disk having a number of percolation holes formed therethrough.
Figure 6:
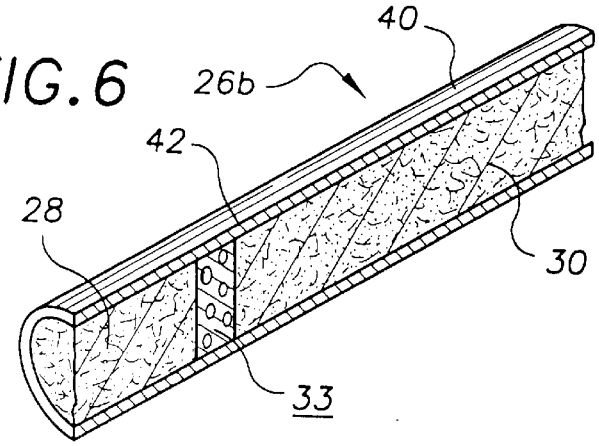
FIG. 6 is a cross sectional view of a third exemplary fibrous wick container showing the shrink sleeve, the first section of fibrous wicking material, the second section of fibrous wicking material, the bleach disk compartment formed between the first and second section of fibrous wicking material, and the solid bleach disk positioned within the bleach granule compartment.

With reference to FIG. 5, the solid organic bleach can be molded into a solid molded bleach disk 42 having a number of percolation holes 44 formed therethrough. Referring to FIG. 6, a third alternative construction of fibrous wick container is shown, generally designated by the reference 26*b*. In this alternative construction, fibrous wick container 26*b* is constructed from an identical length of heat shrinkable plastic tubing 40 into which first section of fibrous wicking material 28 and second section of fibrous wicking material 30 are inserted to form a compartment 33 within which molded bleach disk 42 is held.

Figure 7:
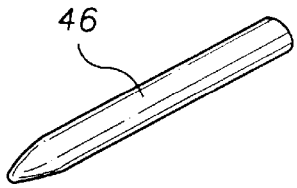
FIG. 7 is a perspective view of a solid bleach spike.
Figure 8:
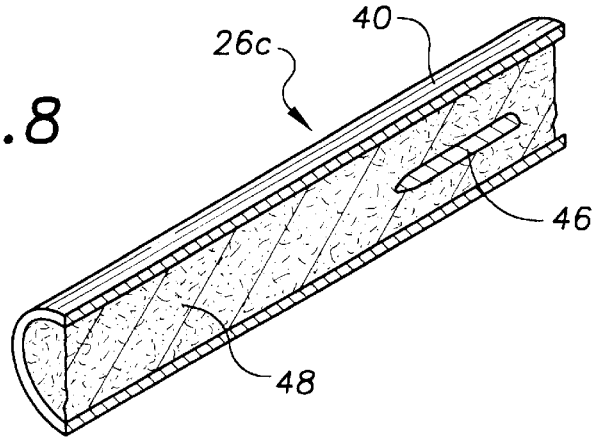
FIG. 8 is a cross sectional view of a fourth exemplary fibrous wick container showing the shrink sleeve, the single section of fibrous wicking material, and the solid bleach spike inserted into the single section of fibrous wicking material.

With reference to FIG. 7, the solid organic bleach can alternatively be molded into a solid molded bleach spike 46. Referring to FIG. 8, a fourth alternative construction of fibrous wick container is shown, generally designated by the reference 26*c*. In this alternative construction, fibrous wick container 26*c* is constructed of an identical length of heat shrinkable plastic tubing 40 into which a plain section of fibrous wicking material 48 has been inserted. In this embodiment, bleach spike 46 is then inserted into plain section of fibrous wicking material 48 prior to applying heat to heat shrinkable plastic tubing 40.

Figure 9:
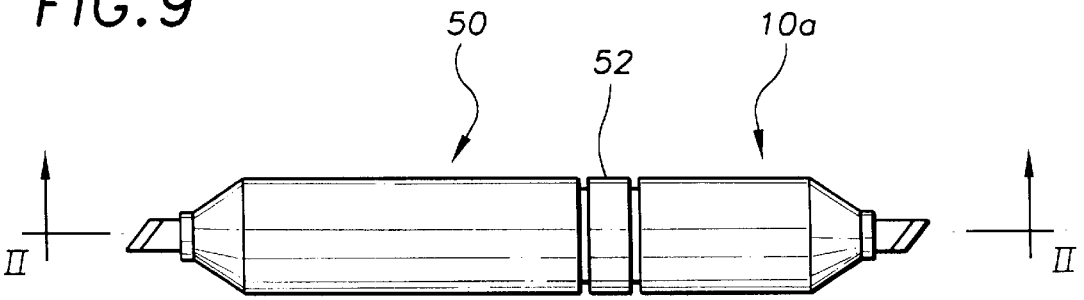
FIG. 9 is a plan view of a second exemplary embodiment of the ink eraser of the present invention incorporated into a combined highlighter/erasing pen showing the highlighter housing, the highlighting nib, the eraser housing, the eraser delivery nib, and the snap-in sealing member used to attach the highlighter housing to the eraser housing.
Figure 10:
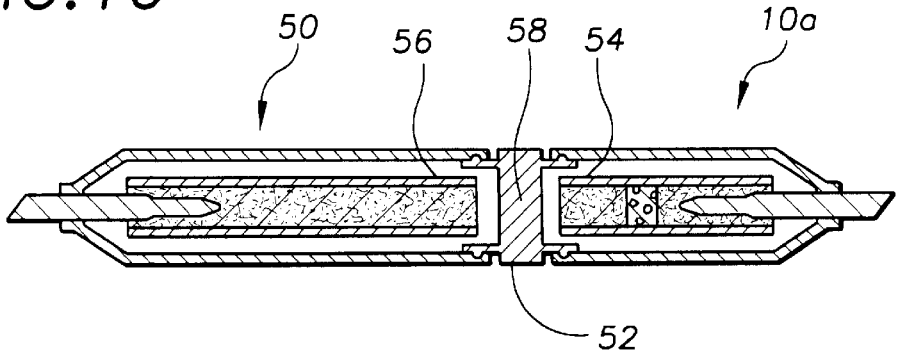
FIG. 10 is a cross-sectional view of the ink eraser of FIG. 9 along the line II—II showing the highlighter housing chamber; the snap-in sealing member; and the eraser housing chamber.

With reference to FIG. 9, a second exemplary embodiment of the ink eraser of the present invention is shown, generally designated by the numeral 10*a*. In this embodiment, ink eraser 10*a* is attached to a conventional highlighter pen, generally designated 50, by a snap in sealing member 52. Referring to FIG. 10, sealing member 52 includes a first snap fitting 54, a second snap fitting 56, and a central sealing portion 58. First snap fitting 54 sealing attaches to ink eraser 10*a*. Second snap fitting 56 sealing attaches to highlighter pen 50. This sealed configuration prevents bleaching of the organic highlighting ink held within highlighter pen 50.

Any embodiments of the ink eraser 10,10*a* are charged by adding a suitable vinegar, such as readily available white household vinegar, to the fibrous wick container 26,26*a*,26*b*, 26*c*. The ink eraser 10,10*a* is then used by simply drawing delivery portion 38 of delivery nib 20 over the highlighter ink to be erased. A conventional nib cap can be provided to cover delivery nib 20 when not in use.

It can be seen from the preceding description that an ink eraser has been provided that includes an erasing mechanism for erasing undesirable highlighting ink from a surface; that can be manufactured with minimal airborne release of the organic bleach during the manufacturing process; that can be recharged by the user solely through the addition of vinegar to an erasing agent storage chamber; that includes a fibrous wick container containing two sections of fibrous wicking material wherein solid bleach granules are positioned between the fibrous wicking sections and adjacent to a delivery nib; and that includes a fibrous wick container containing a section of fibrous wicking wherein the fibrous wicking material has solid bleach granules dispersed throughout prior to insertion of the fibrous wicking into the fibrous wick container.

It is noted that the embodiments of ink eraser described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An eraser comprising:

an eraser housing defining a housing chamber and a nib opening;

a first fibrous wick container positioned within said housing chamber;

a first section of fibrous wicking material positioned within said fibrous wick container;

a second section of fibrous wicking material positioned within said fibrous wick container such that a bleach disk compartment is formed between said first section of fibrous wicking material and said second section of fibrous wicking material;

a solid molded bleach disk positioned within said bleach disk compartment, said solid molded bleach disk having a plurality of percolation holes formed entirely therethrough;

a supply of vinegar saturating said first and said second sections of fibrous wicking material; and a delivery nib having a wick contacting portion, a central portion and a delivery portion, said wick contacting portion being positioned within said fibrous wick container in contact with said first section of fibrous wicking, said central portion being disposed through said nib opening, said delivery portion extending exteriorly of said eraser housing.

* * * * *